United States Patent [19]

Park

[11] Patent Number: 4,550,788

[45] Date of Patent: Nov. 5, 1985

[54] ROOF BOLT HOLE GROOVER

[75] Inventor: Duk-Won Park, Northport, Ala.

[73] Assignee: The Board of Trustees of the University of Alabama, University, Ala.

[21] Appl. No.: 549,736

[22] Filed: Nov. 8, 1983

[51] Int. Cl.[4] ..... E21B 10/32; E21B 7/28

[52] U.S. Cl. ..... 175/173; 175/189; 175/285; 175/286; 175/260

[58] Field of Search ..... 175/286, 285, 170, 173, 175/189, 202, 258–260, 265, 135, 263; 173/48, 104, 109

[56] References Cited

U.S. PATENT DOCUMENTS

| | | | |
|---|---|---|---|
| 391,899 | 10/1888 | Kilpatrick . | |
| 399,156 | 3/1889 | Plom et al. . | |
| 564,508 | 7/1896 | Elliott | 175/173 |
| 564,509 | 7/1896 | Elliott | 175/173 |
| 564,510 | 7/1896 | Elliott | 175/173 |
| 954,826 | 4/1910 | Selleck et al. | 173/109 |
| 994,307 | 6/1911 | Evans et al. . | |
| 998,534 | 7/1911 | Knuckles . | |
| 1,180,014 | 4/1916 | Cook | 175/173 |
| 2,298,792 | 10/1942 | Hicks | 173/104 |
| 3,422,629 | 1/1969 | Watts . | |
| 3,599,734 | 8/1971 | Farris . | |
| 3,774,699 | 11/1973 | Schmuck | 173/109 |
| 3,828,865 | 8/1974 | Schnizler, Jr. | 173/48 |
| 3,874,460 | 4/1975 | Schmid et al. | 173/48 |
| 3,960,222 | 6/1976 | Leibee et al. . | |
| 4,031,972 | 6/1977 | Burg . | |

FOREIGN PATENT DOCUMENTS

| | | | |
|---|---|---|---|
| 517752 | 2/1931 | Fed. Rep. of Germany | 175/189 |

*Primary Examiner*—Stephen J. Novosad
*Assistant Examiner*—Bruce M. Kisliuk
*Attorney, Agent, or Firm*—Oblon, Fisher, Spivak, McClelland & Maier

[57] ABSTRACT

A hole groover comprising a pair of grooving bits radially protruding from the surface of a drill rod and connected to swivel upwardly and downwardly near the end of the drill rod where the drill bit is connected. A connecting rod is connected to the inside ends of the groove bits and causes arcuate movement of the grooving bits as it reciprocates. The hole groover further includes a gear box which is connectable to a rotary drilling unit which converts rotational movement of the rotary drill until to reciprocating movement of a lever. The lever is connected to the connecting rod which causes movement of the grooving bits. The device is readily adaptable to be connected to most rotary drill units and the depth and intervals of the grooves can be easily controlled by adjusting the length of the grooving bits and the gear ratios. The device enables grooves to be cut in a wall hole surface, concurrently with the drilling of the hole.

17 Claims, 8 Drawing Figures

ROOF BOLT HOLE GROOVER

BACKGROUND OF THE INVENTION

1. Field of the Invention

The present invention relates to drilling devices and more particularly to a roof bolt hole groover which cuts grooves simultaneously as the hole is drilled.

2. Description of the Prior Art

In mining, it is often necessary to bolt together a discontinuous rock mass in order to provide a safe mine roof. This is normally accomplished by roof bolting. There are two popular methods of roof bolting, namely point-anchored (or tensioned) and full-length anchored (or nontensioned) bolting. A point-anchored bolt is a bolt anchored at the extreme end located in a roof bolt hole drilled into the rock mass and having a bearing plate connected at the other end of the bolt located at the collar of the hole. On the other hand, a full-length anchor bolt is a bolt grouted with resin or the like throughout the roof bolt hole.

With present devices a roof bolt hole is drilled into a rock mass and a smooth bore hole surface results. The anchoring capacity of the full-length anchor bolt, usually a resin bolt if resin is used, can be enhanced by making the roof bolt hole surface rough. Therefore, rifling tools were developed to scratch or groove the roof bolt hole surface. The roof drilling operation using such a rifling tool required two steps: first step being to drill a hole in the rock mass and the second step to cut rifle grooves in the bore hole surface. The groove inervals and depth are not easily controllable with the presently used rifling tools.

The present invention ameliorates the aforementioned problems of the prior devices by providing a roof bolt hole groover which cuts grooves in the wall hole surface simultaneously as the hole is being drilled.

SUMMARY OF THE INVENTION

Accordingly, it is one object of the present invention to provide a novel roof bolt hole groover which simultaneously grooves the hole as it is being drilled.

It is another object of the present invention to provide a roof bolt hole groover which enables easy control of the interval and depth of the grooves.

It is yet another object of the present invention to provide a novel roof bolt hole grover which is easily connectable to conventional rotary percusive drill units and the like.

In order to accomplish the aforesaid objects, the present invention in one embodiment provides a bolt hole groover comprising a pair of grooving bits pivotally connected to a drill rod and protruding radially therethrough near the connection for the groove drill bit, a connecting rod connected to the pair of grooving bits which causes the grooving bits to move arcuately as the connecting rod reciprocates, and a gear box conversion means operably connected to the rotating portion of the rotary drill unit and the connecting rod, which converts the rotational movement of the rotary drill unit into reciprocating movement in order to cause reciprocating movement of the connecting rod. Simple adjustments of the gear box conversion means and the length of the grooving bits can be made to control the depth and interval of the grooves.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
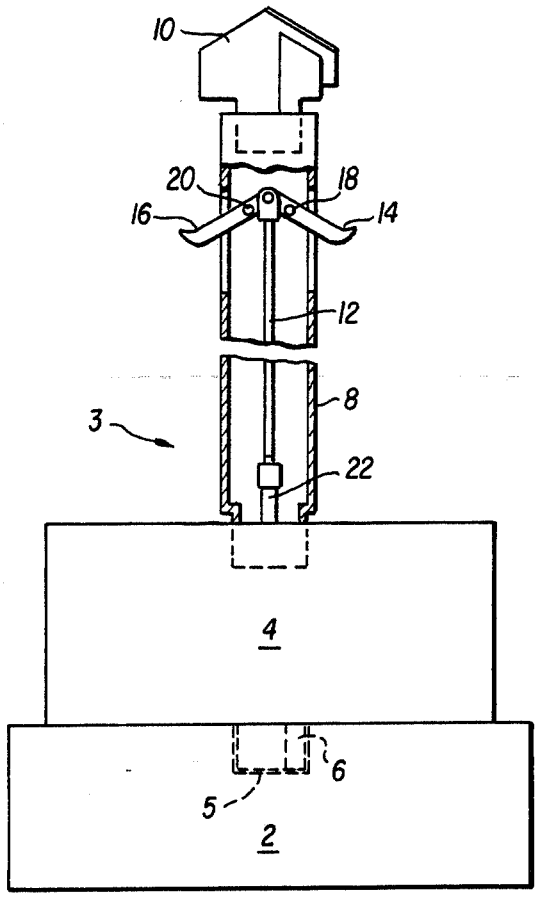
FIG. 1 is a plan view of a first embodiment of the present invention.

Referring now to the drawings, wherein like reference numerals designate identical or corresponding parts throughout the several views, and more particularly to FIG. 1 thereof, a novel roof hole groover is illustrated. The roof hole groover 3 comprises a gear box and housing 4 connected to the rotary drill unit 2 by way of bolts or other means well-known in the art. Gear box and housing 4 includes a drive shaft 6 which connects to the rotary drive portion 5 of the rotary drill unit 2. A hollow drill rod 8 is connected by conventional means to the drive shaft 6 and rotates whenever the rotary drill unit 2 is operated. Drill rod 8 also is designed to receive a drill bit 10 connected thereto by conventional means and also houses groove bits 14 and 16 which are pivotally connected thereto by way of pins 18 and 20. The proximal ends of the groove bits 14 and 16 are pivotally connected to a connecting rod 12 which in turn is connected to a lever 22 which reciprocates in response to rotational movement of the drive shaft 6.

Figure 4:
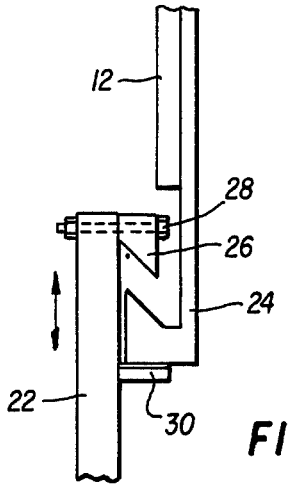
FIG. 4 is a partial view illustrating a connection of the connecting rod 12 to the sliding lever 22 of FIG. 1.

One possible connection of the connecting rod 12 to the lever 22 is illustrated in FIG. 4. In that embodiment, the connecting rod 12 has an L-shaped member 24 connected thereto by conventional means, while the lever 22 has a wedge-shaped portion 26 which is connected thereto by way of a nut and bolt 28 or other suitable means and a stopper portion 30 which can be made integral with the lever 22. Therefore, as the lever 22 reciprocates downwardly, the wedge-shaped portion 26 engages with the L-shaped portion 24 and pulls the connecting rod 12 downwardly, thus causing the distal ends of the groove bits 14 and 16 to swivel upwardly. When the lever 22 reciprocates upwardly, the stopper portion 30 contacts the L-shaped portion 24 and forces the connecting rod 12 upwardly, thus causing the distal ends of the groove bits 14 and 16 to swivel downwardly. It can be appreciated by referring to FIG. 1 that, as the distal ends of the groove bits 14 and 16 swing upwardly, the depth of the grooves is increased, whereas, when the distal ends of the groove bits 14 and 16 swing downwardly, the depth of the grooves is decreased.

Figure 2:
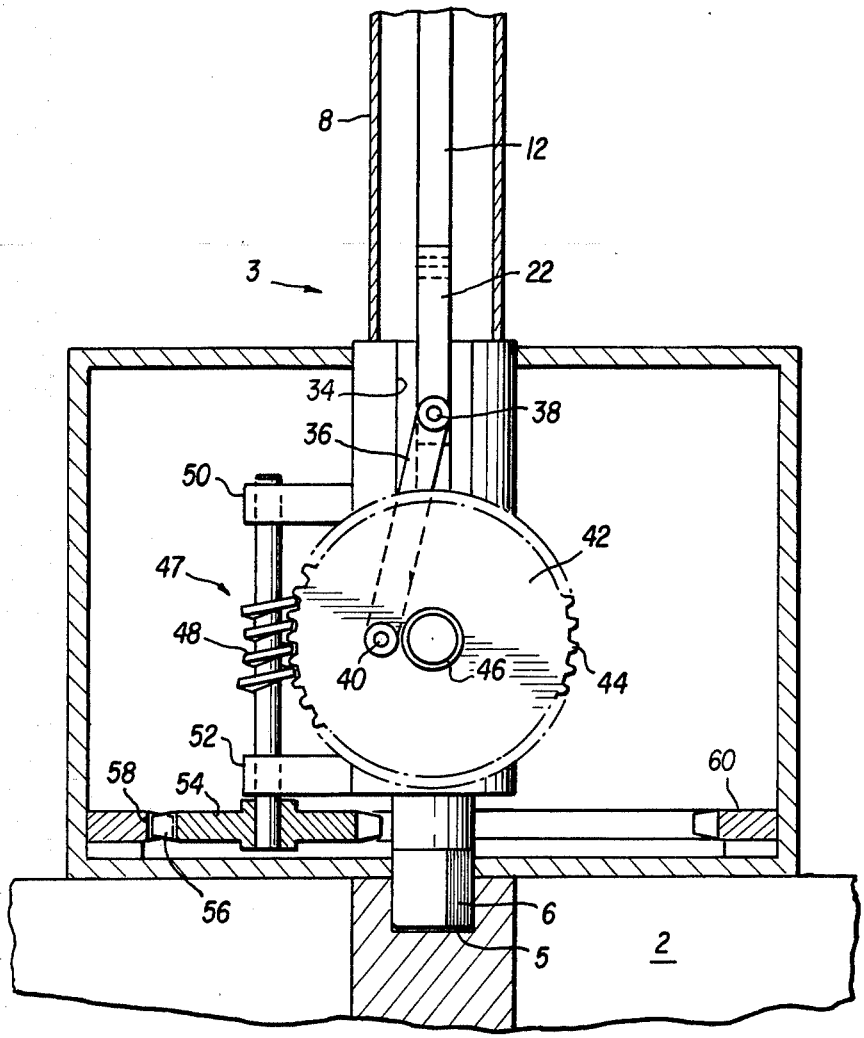
FIG. 2 is a partial cross-sectional view of FIG. 1.
Figure 3:
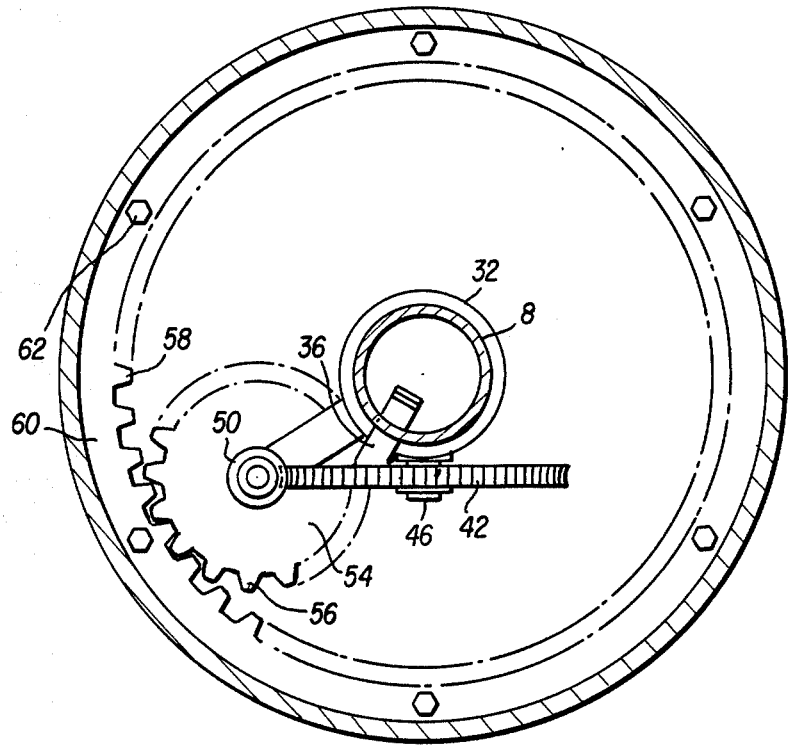
FIG. 3 is a partial top view of FIG. 1.

Referring now to FIGS. 2 and 3, the operation of the gear box 4 which causes the lever 22 to reciprocate can be easily understood. The drive shaft 6 includes a grooved portion 34 which slidably receives the lever 22. The lower end of the lever 22 has the upper end of a second lever 36 pivotally connected thereto by way of a connector pin 38. The other end of the second lever 36 is connected to a helical gear 42 mounted on a gearshaft 46 by way of connecting pin 40 offset from the center of the gear 42 and the gearshaft 46. The gearshaft 46 is mounted to the drive gearshaft 6. Also mounted to the gearshaft 6 are supports 50 and 52 of a worm gear 47. The threads 48 of the worm gear 47 are intermeshed with the teeth 44 of the helical gear 42. The lower end of the worm gear 47 is connected to a spur gear 56 by any conventional means well-known in the art. The periphery of the gear box housing 4 includes the female gear 60 which has inwardly facing teeth 58. The female gear 60 can be bolted to the rotary drill unit 2 by way of bolts 62. The teeth 56 of the spur gear 54 intermesh with the teeth 58 of the female gear 60.

In operation, the rotary drive portion 5 of the rotary drill unit 2 causes the drive shaft 6 to rotate. As the drive shaft 6 rotates, the spur gear 54 rotates as it follows the path of the female gear 60. The rotation of the spur gear 54 in turn causes the worm gear 47 to rotate. The rotation of the worm gear 47 causes the helical gear 42 to rotate and causes the upper end of the second lever 36 to move upwardly and downwardly as the lower end rotates about an offcenter portion of the helical gear 42. As the upper end of the second lever 36 moves upwardly and downwardly, the lever 22 is also caused to reciprocate. The reciprocating motion of the lever 22, as explained previously in the discussion of FIGS. 1 and 4, ultimately causes arcuate movement of the groove bits 14 and 16 to effect the desired grooves in the hole being drilled.

Figure 5:
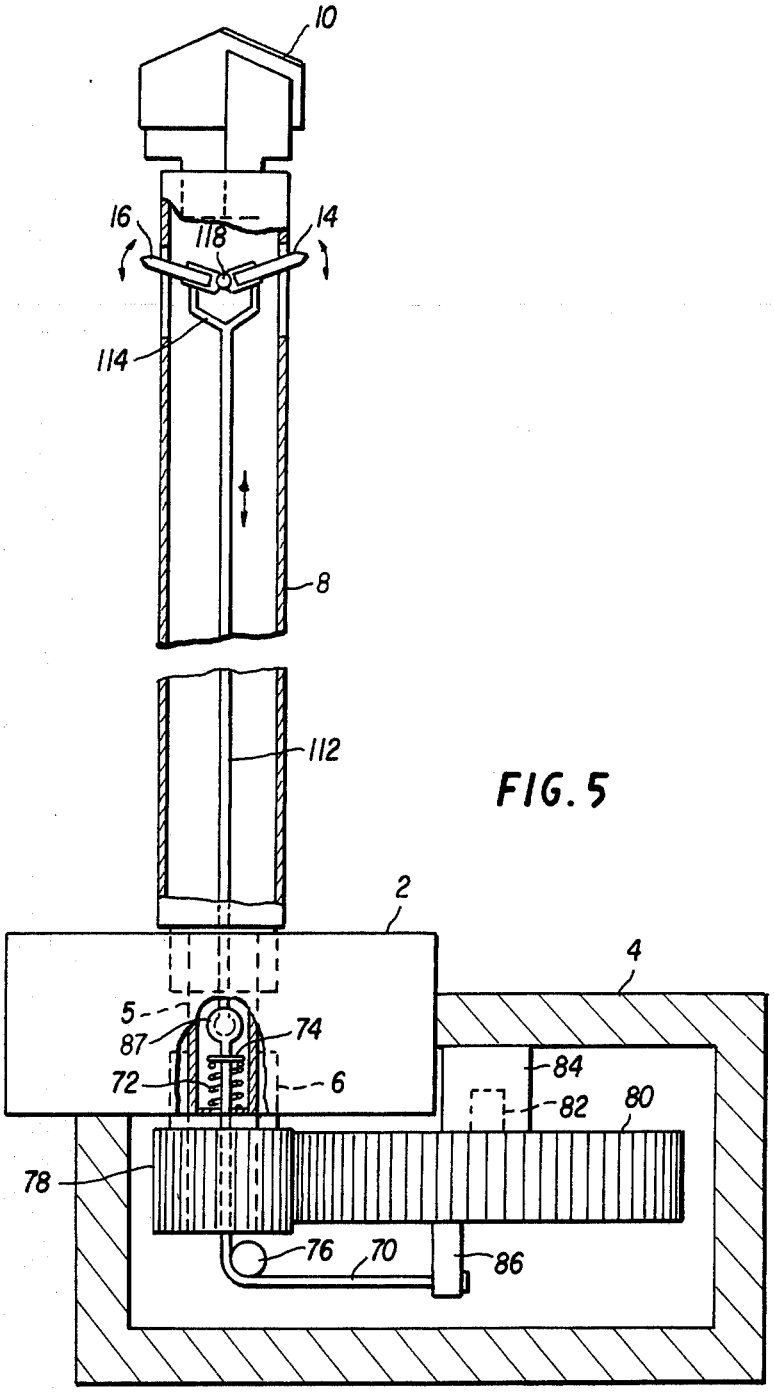
FIG. 5 is a plan view of a second embodiment of the present invention with the gear box portion shown in cross section.

Referring now to FIG. 5, a second embodiment of the present invention is illustrated. In this example, the drill rod 8 is connected directly to the rotary drill unit 2 and includes the drill bit 10 with the groove bits 14 and 16 protruding therefrom. However, in this example a connecting rod 112 has a forked end 114 operably connected to the pin 118 in order to effect the arcuate movement of the distal ends of the groove bits 14 and 16. Also attached to the rotary drill unit 2 on the bottom side is the drive shaft 6 with a spur gear 78 attached thereto. The teeth of the spur gear 78 are intermeshed with the teeth of a second spur gear 80 which has its shaft 82 rotatably mounted to a support 84. The second spur gear 80 also has connected offcenter therefrom a connecting pin 86. The connecting pin 86 is connected by any means well-known in the art to one end of a flexible connector 70 such as a steel wire rope. The other end of the flexible connector 70 is connected to the lower end of the connecting rod 112 by way of a ball joint 87. The upper end of the flexible connector 70 also includes a spring 72 and stopper 74 arrangement to bias the flexible connector 70 upwardly. Flexible connector 70 is forced to change its direction approximately 90° by a guide bar 76 which is connected to the gear box housing 4.

In the above embodiment, when the first spur gear 78 rotates in response to the rotation of the shaft 5 of the rotary drill unit 2, the second spur gear 80 is also caused to rotate, which moves the connecting pin 86 about the center point thereof, ultimately causing horizontal reciprocating motion of the lower portion of the flexible connector 70. The horizontal reciprocating motion of the flexible connector 70 is transferred to vertical reciprocating motion by way of the guide bar 76 and causes the distal ends of the groove bits 14 and 16 to move arcuately in response thereto. The ball joint 87 is used in this embodiment to prevent the flexible connector 70 from rotating with the connecting rod 112, which would render the device inoperative.

Figure 6:
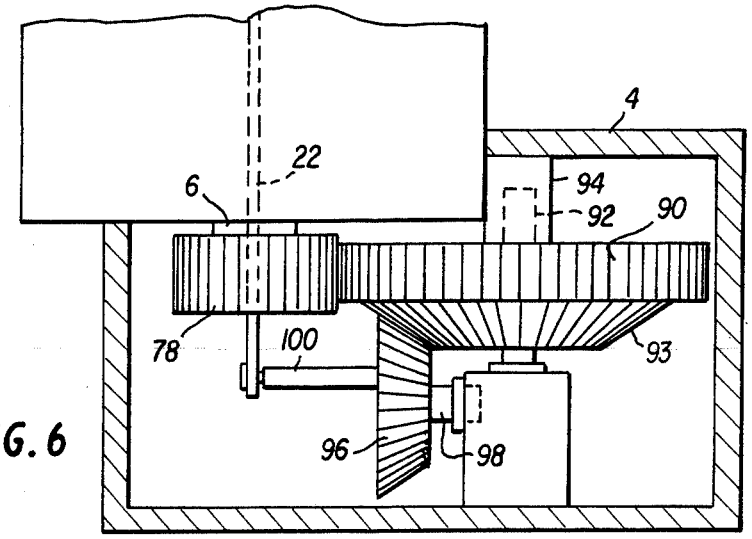
FIG. 6 is a partial plan view of a third embodiment of the present invention showing the gear box portion in cross section.

Referring now to FIG. 6, a third embodiment of the gear box portion of the invention is illustrated. In this embodiment the spur gear 78 is connected to the drive shaft 6, and the drive shaft 6 rotates in response to the rotary movement of the rotary drill unit 2. The teeth of the spur gear 78 are intermeshed with the teeth of a second spur gear 90 which has a shaft 92 connected to the support 94. A first bevel gear 93 is concentric to and rotates with the second spur gear 90. A second bevel gear 96 has its teeth intermeshed with the teeth of the first bevel gear 90, and the second bevel gear shaft 98 is rotatably mounted to the shaft 92 of the first bevel gear 90. The second bevel gear 96 has a connecting pin 100 one end of which is connected offcenter on its surface facing the lever 22. The other end of the connecting pin 100 pivotally connected to the lower end of the lever 22. Therefore, when the spur gear 78 rotates, the first bevel gear 93 is caused to rotate, which in turn causes the second bevel gear 96 to rotate and the connecting pin 100 to rotate about the center thereof of the second bevel gear 96. The rotation of the connecting pin 100 causes reciprocating movement of the lever 22 in order to drive the groove bits 14 and 16 as in the previous embodiments.

Figure 7:
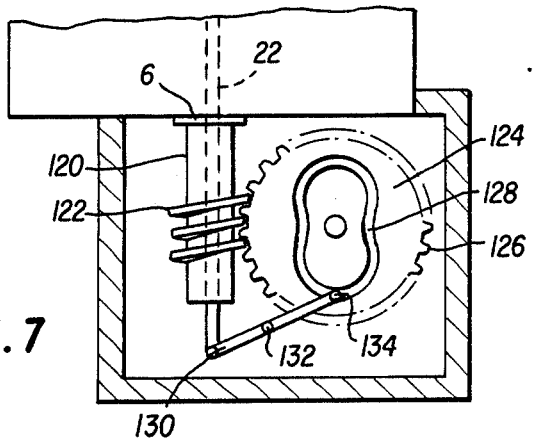
FIG. 7 is a partial plan view of a fourth embodiment of the present invention with the gear box portion shown in cross section.

Referring now to FIG. 7, a fourth embodiment of the gear box 4 of the present invention is illustrated. In this embodiment, a worm gear 120 is shown connected to the drive shaft 6, which rotates in response to the rotary drill unit 2. The threads 122 of the worm gear 120 are intermeshed with the threads 126 of a heclical gear 124 which is rotatably mounted to the gear box housing 4. The helical gear 124 also includes a patterned groove 128 in the planar surface thereof. A pivoting lever 130 is connected to the gear box 4 by way of a pin 132. One end of the pivoting lever 130 carries a groove follower 134 which is slidably mounted on the lever 130 to permit lost motion therebetween and which slides within the groove 128 in the helical gear 124. The linkage between the groove follower 134 and the helical gear 124 causes the other end of the pivoting lever 130 to move arcuately about the pivot pin 132. Again, this ultimately results in the reciprocating movement of the lever 22.

Figure 8:
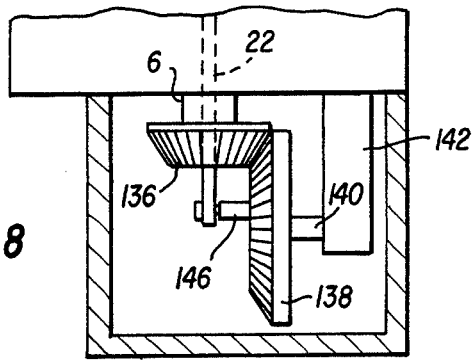
FIG. 8 is a partial plan view of a fifth embodiment of the present invention with the gear box portion shown in cross section.

Referring now to FIG. 8, a fifth embodiment of the present invention is illustrated wherein a bevel gear 136 is connected to the drive shaft 6 of the gear box 4. The teeth of the bevel gear 136 are intermeshed with the teeth of a second bevel gear 138 which has a shaft 140 connected to the housing 4 by way of a support 142. The second bevel gear 138 has a connecting pin 146 connected offcenter on its surface facing the first bevel gear 136. The connecting pin 146 rotates about the center of the second bevel gear 138 as the second bevel gear 138 rotates in response to rotation of the first bevel gear 136. The lever 22 is pivotally connected to the connecting pin 146 and reciprocates in response to the rotational movement of the second bevel gear 138.

Therefore, the operation of the groove bits 14 and 16 is again effected as previously described.

It should be noted that, with the embodiment illustrated in FIG. 1, the groove bits 14 and 16 groove the drill hole surface as they swing upwardly. This is the preferred method, as it prevents jamming of the groove bits 14 and 16 while drilling is in process. However, it is possible to shape the groove bits 14 16 so that they groove the drill hole surface as they swing downwardly.

Obviously, numerous (additional) modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A drilling device for use in bolting together a discontinuous rock mass in order to provide a safe mine roof, said drilling device comprising:

(a) a hollow drill rod having a first axis;

(b) a drill bit mounted on the distal end of said hollow drill rod;

(c) at least two groove bits pivotally mounted in said hollow drill rod, the distal ends of said groove bits projecting through slots in said hollow drill rod over at least part of the pivotal motion of said groove bits and extending radially outwardly beyond the diameter of said drill bit, said at least two groove bits being shaped to score the surface of a hole drilled by said drill bit during use of the drilling device;

(d) a connecting rod disposed inside said hollow drill rod, the distal end of said connecting rod being operatively connected to said at least two groove bits such that axial reciprocating motion of said connecting rod causes pivotal reciprocating motion of said at least two groove bits;

(e) first means for rotating said hollow drill rod about said first axis; and (f) second means for axially reciprocating said connecting rod, said second means comprising:

(i) a worm gear operatively connected to said first means and radially offset from said hollow drill rod such that said worm gear rotates in a circle which is concentric to said hollow drill rod, said worm gear being rotatable about a second axis which is parallel to said first axis but which rotates around said first axis;

(ii) a planetary spur gear operatively connected to said worm gear such that said planetary spur gear rotates about said second axis and such that the rotational motion of said planetary spur gear is transferred to said worm gear;

(iii) a stationary female sun gear which is concentric to said first axis and which meshes with said planetary spur gear;

(iv) a helical gear which meshes with said worm gear and which is mounted for rotation about a third axis which is perpendicular to said first axis;

(v) a conecting pin which is eccentrically mounted on said helical gear about a fourth axis which is parallel to said third axis but which rotates around said third axis; and (vi) a first link the distal end of which is operatively connected to said connecting rod and the proximal end of which is connected to said connecting pin, whereby said first means causes said worm gear and said planetary spur gear to rotate about said first axis, the meshing of said planetary spur gear with said stationary female sun gear causes said planetary spur gear and said worm gear to rotate about said second axis, the rotation of said worm gear about said second axis causes said helical gear to rotate about said third axis, the rotation of said helical gear about said third axis causes said connecting pin to rotate about said third axis, the rotation of said connecting pin about said third axis causes the distal end of said first link to reciprocate axially, the axial reciprocation of the distal end of said first link causes said connecting rod to reciprocate axially, and the axial reciprocation of said connecting rod causes said at least two groove bits to reciprocate pivotally, thereby scoring the surface of the holding drilled by said drill bit during use of the drilling device.

2. A drilling device as recited in claim 1 and further comprising a second link:

(a) the proximal end of which is pivotally connected to the distal end of said first link and (b) the distal end of which is operatively connected to said connecting rod by lost motion means which transmit intermittent motion from said second link to said connecting rod.

3. A drilling device as recited in claim 1 wherein said connecting rod is constrained to move parallel to said first axis.

4. A drilling device for use in bolting together a discontinuous rock mass in order to provide a safe mine roof, said drilling device comprising:

(a) a hollow drill rod having a first axis;

(b) a drill bit mounted on the distal end of said hollow drill rod;

(c) at least two groove bits pivotally mounted in said hollow drill rod, the distal ends of said groove bits projecting through slots in said hollow drill rod over at least part of the pivotal motion of said groove bits and extending radially outwardly beyond the diameter of said drill bit, said at least two groove bits being shaped to score the surface of a hole drilled by said drill bit during use of the drilling device;

(d) a connecting rod disposed inside said hollow drill rod, the distal end of said connecting rod being operatively connected to said at least two groove bits such that axial reciprocating motion of said connecting rod causes pivotal reciprocating motion of said at least two groove bits;

(e) first means for rotating said hollow drill rod about said first axis; and (f) second means for reciprocating said connecting rod, said second means comprising:

(i) a first spur gear operatively connected to said first means such that said first means causes rotation of said first spur gear;

(ii) a second spur gear which meshes with said first spur gear;

(iii) a connecting pin which is eccentrically mounted on said second spur gear;

(iv) a flexible connector the proximal end of which is attached to said connecting pin and the distal end of which is operatively connected to said connecting rod; and (v) third means for resiliently biasing said flexible connector so as to take up the slack in said flexible connector caused by the motion of said connecting pin, whereby said first means causes said first spur gear to rotate, the meshing of said first spur gear with said second spur gear causes said second spur gear and said connecting pin to rotate, the rotation of said connecting pin causes said flexible connector to reciprocate axially, the axial reciprocation of said flexible connector causes said connecting rod to reciprocate axially, and the axial reciprocation of said connecting rod causes said at least two groove bits to reciprocate pivotally, thereby scoring the surface of the hole being drilled by said drill bit during use of the drilling device.

5. A drilling device as recited in claim 4, wherein:

(a) said first spur gear rotates about said first axis;

(b) said second spur gear rotates about a second axis which is parallel to but offset from said first axis; and (c) said flexible connector is trained over a guide means which changes its direction intermediate said connecting pin and said connecting rod.

6. A drilling device as recited in claim 4, wherein said third means comprise:

(a) a first spring seat fastened to and movable with said flexible connector and (b) a spring the distal end of which bears against said first spring seat and the proximal end of which bears against a second, fixed spring seat.

7. A drilling device as recited in claim 4 wherein said flexible connector is operatively connected to said connecting rod by means of a ball joint.

8. A drilling device for use in bolting together a discontinuous rock mass in order to provide a safe mine roof, said drilling device comprising:

(a) a hollow drill rod having a first axis;

(b) a drill bit mounted on the distal end of said hollow drill rod;

(c) at least two groove bits pivotally mounted in said hollow drill rod, the distal ends of said groove bits projecting through slots in said hollow drill rod over at least part of the pivotal motion of said groove bits and extending radially outwardly beyond the diameter of said drill bit, said at least two groove bits being shaped to score the surface of a hole drilled by said drill bit during use of the drilling device;

(d) a connecting rod disposed inside said hollow drill rod, the distal end of said connecting rod being operatively connected to said at least two groove bits such that axial reciprocating motion of said connecting rod causes pivotal reciprocating motion of said at least two groove bits;

(e) first means for rotating said hollow drill rod about said first axis; and (f) second means for axially reciprocating said connecting rod, said second means comprising:

(i) a first spur gear operatively connected to said first means such that said first means causes rotation of said first spur gear;

(ii) a second spur gear which meshes with said first spur gear;

(iii) a first bevel gear which is concentric to and rotates with second spur gear;

(iv) a second bevel gear which meshes with said first bevel gear; and (v) a connecting pin the proximal end of which is eccentrically mounted on said second bevel gear and the distal end of which is operatively connected to the proximal end of said connecting rod by means which permit pivotal motion between said connecting pin and said connecting rod, whereby said first means causes said first spur gear to rotate, the meshing of said first spur gear with said second spur gear causes said second spur gear and said first bevel gear to rotate, the meshing of said first bevel gear with said second bevel gear causes said second bevel gear and said connecting pin to rotate, the rotation of said connecting pin causes said connecting rod to reciprocate axially, and the axial reciprocation of said connecting rod causes said at least two groove bits to reciprocate pivotally, thereby scoring the surface of the hole being drilled by said drill bit during use of the drilling device.

9. A drilling device as recited in claim 8, wherein said connecting pin is operatively connected to said connecting rod by a link;

(a) the proximal end of which is pivotally attached to the distal end of said connecting pin and (b) the distal end of which is operatively connected to said connecting rod by lost motion means which transmit intermittent motion from said link to said connecting rod.

10. A drilling device as recited in claim 8 wherein:

(a) said first spur gear rotates about said first axis;

(b) said second spur gear and said first bevel gear rotate about a second axis which is parallel to but offset from said first axis; and (c) said second bevel gear rotates about a third axis which is perpendicular to said second axis.

11. A drilling device for use in bolting together a discontinuous rock mass in order to provide a safe mine roof, said drilling device comprising:

(a) a hollow drill rod having a first axis;

(b) a drill bit mounted on the distal end of said hollow drill rod;

(c) at least two groove bits pivotally mounted in said hollow drill rod, the distal ends of said groove bits projecting through slots in said hollow drill rod over at least part of the pivotal motion of said groove bits and extending radially outwardly beyond the diameter of said drill bit, said at least two groove bits being shaped to score the surface of a hole drilled by said drill bit during use of the drilling device;

(d) a connecting rod disposed inside said hollow drill rod, the distal end of said connecting rod being operatively connected to said at least two groove bits such that axial reciprocating motion of said connecting rod causes pivotal reciprocating motion of said at least two groove bits;

(e) first means for rotating said hollow drill rod about said first axis; and (f) second means for axially reciprocating said connecting rod, said second means comprising:

(i) a worm gear operatively connected to said first means such that said first means causes rotation of said worm gear;

(ii) a helical gear which meshes with said worm gear;

(iii) a cam which rotates with said helical gear;

(iv) a pivotally mounted first link the distal end of which is operatively connected to the proximal end of said connecting rod by means which permit pivotal motion between said connecting rod and said first link; and (v) a cam follower operatively connected to said cam and mounted on the proximal end of said first link by means which permit lost motion between said cam follower and said first link, whereby said first means causes said worm gear to rotate, the meshing of said worm gear and said helical gear causes said helical gear and said cam to rotate, the rotation of said cam causes said first lever to reciprocate pivotally, the pivotal reciprocation of said first lever causes said connecting rod to reciprocate axially, and the axial reciprocation of said connecting rod causes said at least two groove bits to reciprocate pivotally, thereby scoring the surface of the hole being drilled by said drill bit during use of the drilling device.

12. A drilling device as recited in claim 11 wherein said first link is operatively connected to said connecting rod by a second link:

(a) the proximal end of which is pivotally connected to the distal end of said first link and (b) the distal end of which is operatively connected to said connecting rod by lost motion means which transmit intermittent motion from said second link to said connecting rod.

13. A drilling device as recited in claim 11 wherein:

(a) said worm gear rotates about said first axis and (b) said helical gear rotates about a second axis which is perpendicular to and offset from said first axis.

14. A drill drilling device as recited in claim 11 wherein said cam is a closed groove formed in a face of said helical gear.

15. A drilling device for use in bolting together a discontinuous rock mass in order to provide a safe mine roof, said drilling device comprising:

(a) a hollow drill rod having a first axis;

(b) a drill bit mounted on the distal end of said hollow drill rod;

(c) at least two groove bits pivotally mounted in said hollow drill rod, the distal ends of said groove bits projecting through slots in said hollow drill rod over at least part of the pivotal motion of said groove bits and extending radially outwardly beyond the diameter of said drill bit, said at least two groove bits being shaped to score the surface of a hole drilled by said drill bit during use of the drilling device;

(d) a connecting rod disposed inside said hollow drill rod, the distal end of said connecting rod being operatively connected to said at least two groove bits such that axial reciprocating motion of said connecting rod causes pivotal reciprocating motion of said at least two groove bits;

(e) first means for rotating said hollow drill rod about said first axis; and (f) second means for axially reciprocating said connecting rod, said second means comprising:

(i) a first bevel gear operatively connected to said first means such that said first means causes rotation of said first bevel gear;

(ii) a second bevel gear which meshes with said first bevel gear; and (iii) a connecting pin the proximal end of which is eccentrically mounted on said second bevel gear and the distal end of which is operatively connected to the proximal end of said connecting rod by means which permit pivotal motion between said connecting pin and said connecting rod, whereby said first means causes said first bevel gear to rotate, the meshing of said first bevel gear with said second bevel gear causes said second bevel gear and said connecting pin to rotate, the rotation of said connecting pin causes said connecting rod to reciprocate axially, and the axial reciprocation of said connecting rod causes said at least two groove bits to reciprocate pivotally, thereby scoring the surface of the hole being drilled by said drill bit during use of the drilling device.

16. A drilling device as recited in claim 15 wherein said connecting pin is operatively connected to said connecting rod by a link:

(a) the proximal end of which is pivotally attached to the distal end of said connecting pin and (b) the distal end of which is operatively connected to said connecting rod by lost motion means which transmit intermittent motion from said link to said connecting rod.

17. A drilling device as recited in claim 15 wherein:

(a) said first bevel gear rotates about said first axis and (b) said second bevel gear rotates about a second axis which is perpendicular to said first axis.

* * * * *